United States Patent [19]

Klein

[11] 4,062,212

[45] Dec. 13, 1977

[54] KEY CASE

[75] Inventor: Ludolf Klein, Great Neck, N.Y.

[73] Assignee: Richton International Corporation, New York, N.Y.

[21] Appl. No.: 692,026

[22] Filed: June 1, 1976

[51] Int. Cl.[2] ..... A47G 29/10

[52] U.S. Cl. ..... 70/456 B

[58] Field of Search ..... 70/456 B, 456 R, 457, 70/458, 459; 150/40; 24/3 K

[56] References Cited

U.S. PATENT DOCUMENTS

| | | | |
|---|---|---|---|
| 1,904,354 | 4/1933 | Buxton | 150/40 |
| 2,297,324 | 9/1942 | Reger | 150/40 |
| 3,318,354 | 5/1967 | Borisof | 70/456 R X |

*Primary Examiner*—Robert L. Wolfe
*Attorney, Agent, or Firm*—Salter & Michaelson

[57] ABSTRACT

A key case having a body portion in which a key carrier assembly is mounted having key retainers releasably mounted thereon, a tab member being interconnected to the body portion and extending outwardly therefrom, and a key that is used frequently being releasably interconnected to the tab member and being removably located in an exterior pocket formed as part of the body portion.

9 Claims, 5 Drawing Figures

KEY CASE

BACKGROUND OF THE INVENTION

The present invention relates to a key case and is of the type that incorporates a key carrier assembly therein on which a plurality of key retainers are releasably mounted.

Key cases as previously used heretofore and that included a key carrier assembly therein were normally constructed such that a preferred key for use was selected from those that were mounted on the key retainers, and the selected key and its key retainer were than pivotally moved relative to the key carrier assembly to expose the selected key for use. Thereafter, the selected key was returned to its normal position interiorly of the key case enclosed therein by a suitable lock construction as incorporated in the body of the key case.

Although the prior known key case constructions were suitable for the use intended, it sometimes was inconvenient to select a preferred key that was frequently used since it was only one of several as contained in the key case body. Some efforts have been made to overcome the inconvenience of searching for a preferred key, and such prior known devices have provided means for segregating a key which is used more often than other keys. This has taken the form in some instances of a key holder as illustrated in U.S. Pat. No. 2,297,324, wherein a selected or preferred key was located exteriorly of the key holder and was mountable in an outside pocket that was formed on the exterior portion of the holder. Thus, the user had immediate access to the preferred key that was normally located in the outside pocket.

Although a key holder as illustrated in U.S. Pat. No. 2,297,324 would serve the purpose intended, the constructional arrangement thereof could not withstand long term or abusive use of the key holder, since the chain on which the keys were mounted was easily subject to breaking. Other devices known heretofore have also incorporated the concept of utilizing an exterior pocket for retaining a key therein, but in all of these forms of the prior devices, the key was interconnected to a member that was not associated with a key retainer assembly.

SUMMARY OF THE INVENTION

The key case as embodied herein avoids the deficiencies of the prior known devices and provides a unique arrangement for segregating a key which is used more frequently than the other keys that are contained in the key case construction. A key carrier assembly is joined to a central portion of the key case and includes a carrier bracket on which a plurality of key retainers are releasably mounted, a tab member being interconnected to the central portion and extending outwardly therefrom. The key that is used most frequently is releasably interconnected to the tab member and is normally located in exposed relation exteriorly of the body portion so that ready access may be made thereto. If desired, the frequently used key can be quickly and completely separated from the tab so that the key case can be replaced in the pocket of the user while the key remains free to use.

Accordingly, it is the object of the present invention to provide a means for segregating a frequently used key from a key carrier assembly and to interconnect the key to a tab that is formed as an integral part of the key case, the tab providing for releasable connection of the key thereto.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
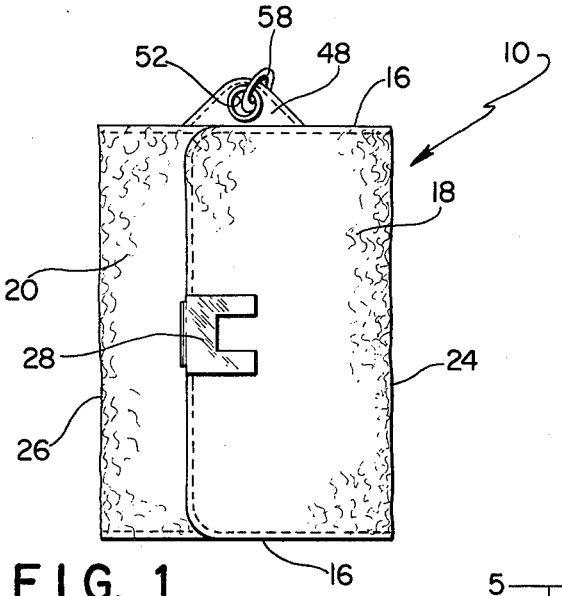
FIG. 1 is a top plan view of the key case embodied in the present invention showing the device in the closed position thereof.
Figure 2:
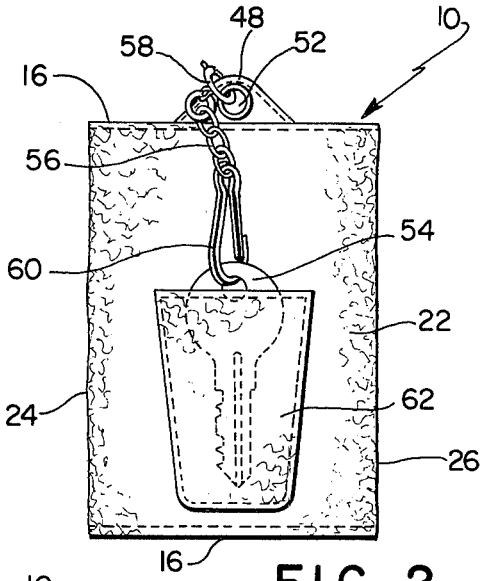
FIG. 2 is a bottom plan view of the key case showing the location of the exterior pocket and a key as inserted therein when not in use.
Figure 3:
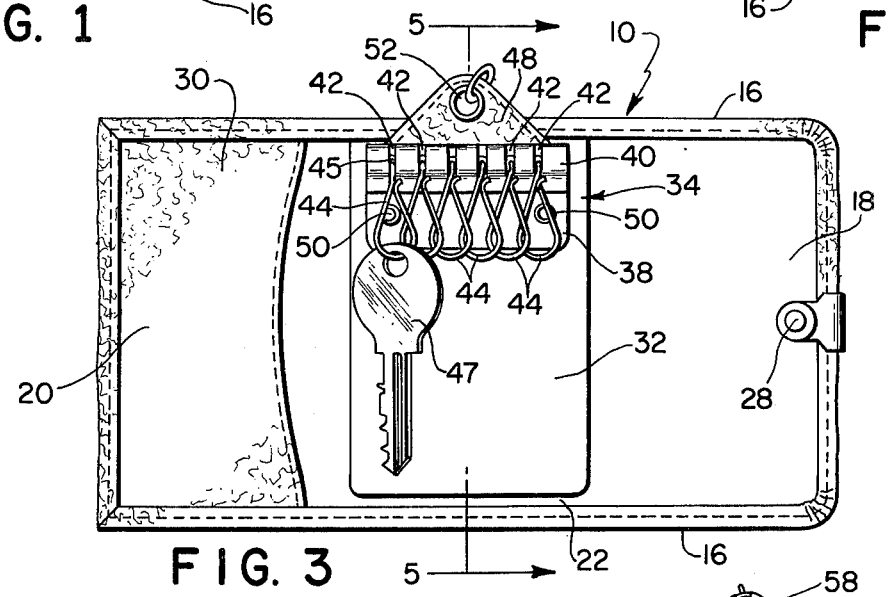
FIG. 3 is a top plan view of the key case as located in the open position thereof and illustrating the key carrier assembly mounted therein.
Figure 4:
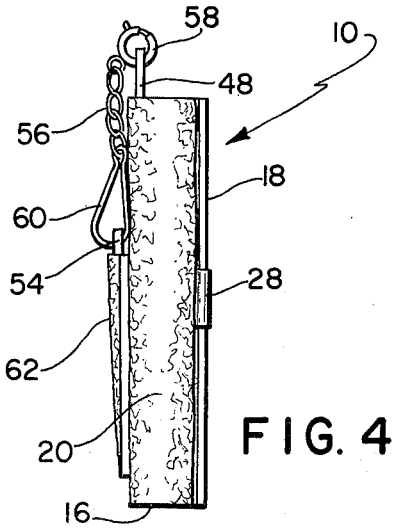
FIG. 4 is a side elevational view of the key case as shown in FIGS. 1 and 2.

Referring now to the drawing and particularly to FIGS. 1, 2 and 3, the key case embodied in the present invention is illustrated and is generally indicated at 10. The key case 10 is generally conventional in the construction thereof, and for this purpose is formed with an outer panel 12 to which an inner panel 14 is joined along a marginal edge 16 thereof. The panels 12 and 14 which define the body portion of the key case 10 are preferably formed of a leather material; although, it is contemplated that other materials such as a plastic may be utilzed for the body portion, without departing from the spirit of the invention. As illustrated in FIG. 3, the panels 12 and 14 that define the body portion of the key case 10 include end portions 18 and 20 that are integrally joined to a central portion 22 along fold lines indicated at 24 and 26 in FIG. 1, the end portion 18 being foldable in overlapping relation over the end portion 20 and being connectable thereto by means of a suitable fastening element. In this connection, a snap fastener is utilized, a male portion 28 of the snap fastener being mounted on the end portion 18 and a female portion of the fastener (not shown) being fixed to the exterior part of the end portion 20. It is understood that the female portion of the fastener receives the male portion 28 therein for securing the key case construction in the closed position as illustrated in FIG. 1. An interior panel 30 is secured to the inside of the end portion 20 along the marginal edge 16 and defines an inside pocket for receiving cards and other similar articles therein.

Figure 5:
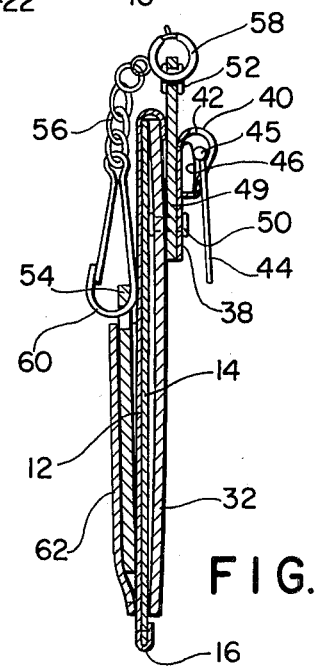
FIG. 5 is a vertical sectional view taken along line 5—5 in FIG. 3.

Joined to the marginal edge 16 of the central portion 22 is an interior panel 32 to which a key carrier assembly generally indicated at 34 is secured. The interior panel 32 defines a stiffener member for mounting of the key carrier assembly 34 thereon; and as will be described, rivets that secure the key carrier assembly 34 in place engage the interior panel 32 and are thus prevented from entering the central portion 20 and extending therethrough. The key carrier assembly 34 as shown in FIGS. 3 and 5, includes a base plate 38 to which a key retainer mounting bracket 40 is joined. The key retainer mounting bracket 40 is formed as an extension of the base plate 38 and is reversely bent and curved forwardly with respect thereto so as to be spaced therefrom. Formed in the key retaining mounting bracket 40 are a plurality of slots 42 that terminate at the lower ends thereof in enlarged openings. A plurality of key retainers 44 each having a spherical head 45 formed thereon are receivable within the slots 42 in locked relation. A spring 46 is disposed within the key retaining mounting bracket 40 and is urged inwardly upon pressure being exerted thereon by the spherical head 45 of the key retainer 44 to enable the head 45 of the key retainer 44 to be removed from the enlarged opening that communicates with the slot 42, thereby releasing the key retainer 44 from the key carrier assembly 34. As shown in FIG. 3, a key 47 is mounted on one of the key retainers 44 and normally overlies the interior panel 32 in the mounted position within the body portion.

One of the objects of the invention is to locate a preferred key, that is a key that is used frequently, in an exterior position relative to the key carrier assembly 34, and for this purpose a tab member 48 is provided and is located outwardly of the key carrying bracket 40 and extends beyond the confines of the body portion of the key case. As further shown in FIG. 5, the tab 48 is integrally joined to an interior portion 49 that is sandwiched between interior panel 32 and the base plate 38 of the key carrier assembly 34. Rivets 50 extend through the base plate 38, interior portion 49 of the tab, and the panel 32, and without projecting through the central portion 22 of the body portion of the key case, the rivets 50 lock the assembly together.

As shown in FIGS. 1, 2 and 3, the configuration of the tab 48 as it extends outwardly of the marginal edge 16 is somewhat triangular, an opening defined by a grommet 42 being located in the tab adjacent to the exposed apex portion thereof. A preferred or frequently used key 54 is interconnected to the tab 48 through a link chain 56 on one end of which a spring ring 58 is mounted that is receivable within the grommet 52. Secured to the other end of the chain 56 is a snap hook 60, on which the key 54 is releasably mounted. In order to prevent the key 54 from dangling loosely exteriorly of the key case 10, a pocket is formed by an exterior strip of material 62 that is joined to the exterior surface of the central portion 22 along the marginal edges of the sides thereof. The material 62 is open at the upper end thereof to define the mouth of the pocket for receiving the key 54 therein. As illustrated in FIGS. 2 and 5, the chain 56 is of a dimension that enables the key 54 to be easily inserted within the pocket as formed on the rear of the key case so that the key 54 is readily accessible when it is desired to be used.

It is seen that by locating the tab 48 exteriorly of the key case so that it projects outwardly from the marginal portion 16 adjacent to the key carrier assembly 34, the selected or preferred key 54 is conveniently mounted in place on the chain 56 that is secured to the tab 48, the preferred key 54 being easily accessible for use or for insertion into the pocket as formed on the rear side of the key case. If desired, the key 54 may also be located within the key case when it is disposed in a closed position thereof, it only being necessary to remove the key 54 from the exterior pocket and place it interiorly of the central portion in overlying relation relative to the panel 32.

It is also seen that the preferred key 54 may be completely removed from the assembly by disengaging the spring ring 58 from the grommet opening 52. In this instance, if the preferred key 54 were to be retained in the ignition of the vehicle, for example, when parking the vehicle in a public parking lot, the key 54 is removable from the key case by disengaging the spring ring 58 from the tab 46, as described, thereby enabling the user to retain the key case on his person while permitting the key 54 to remain in the ignition of the vehicle.

Whenever it is necessary to use one of the other keys as mounted on the key carrier assembly 34, the key 54 is inserted into its pocket, and the key case is moved to the open position as shown in FIG. 3. A selected key is then moved with its key retainer to an exposed position for use. Because of the ease of assembly and disassembly of a preferred key on the snap hook 60, any key may be mounted thereon as desired depending upon the frequency of use thereof.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A key case comprising a body portion formed of at least one sheet of flexible material that is bendable along fold lines formed transversely of said sheet, wherein a central portion is defined between said fold lines and is integrally joined to end portions, fastening means mounted on said end portions for securing said end portions in folded fastened relation, a key carrier assembly joined to said central portion for enclosure by said end portions and including a base plate and a carrier bracket joined to said base plate and on which a plurality of key retainers are releasably mounted, means joined to said central portion for releasably attaching to said key case an individual key that is used frequently, said frequently used key being normally located in exposed relation exteriorly of said body portion for ready access thereto, said attaching means including a first portion that is exposed of said central portion a second portion that is located adjacent to said base plate, wherein said frequently used key is readily accessible for use without moving said end portions to an open position for exposure of said key carrier assembly.

2. A key case comprising a body portion formed of at least one sheet of flexible material that is bendable along fold lines formed transversely of said sheet, wherein a central portion is defined between said fold lines and is integrally joined to end portions, fastening means mounted on said end portions for securing said end portion in folded fastened relation, a key carrier assembly joined to said central portion for enclosure by said end portions and including a carrier bracket on which a plurality of key retainers are releasably mounted, a tab member interconnected to said central portion and extending outwardly therefrom, and a key that is used frequently being releasably interconnected to said tab member and being normally located in exposed relation exteriorly of said body portion for ready access thereto, a pocket formed on the exterior face of said central portion and having the mouth thereof located adjacent to said tab member wherein said key as secured to said tab member is receivable in said pocket when not in use, an interior panel joined only to an edge of said central portion and extending substantially the length thereof so that it is normally located in parallel relation to said central portion, but is hingedly movable relative thereto, said tab member and key carrier assembly being connected to said interior panel and movable therewith when it is hinged relative relative to said central portion, said tab member having an interior portion integrally joined to said apex portion and underlying said key carrier assembly in parallel relation for securely mountng said tab member on said interior panel.

3. A key case comprising a body portion formed of at least one sheet of flexible material that is bendable along fold lines formed transversely of said sheet, wherein a central portion is defined between said fold lines and is integrally joined to end portions, fastening means mounted on said end portions for securing said end portions in folded fastened relation, a key carrier assembly joined to said central portion for enclosure by said end portions and including a carrier bracket on which a plurality of key retainers are releasably mounted, a tab member interconnected to said central portion and extending outwardly therefrom, and a key that is used frequently being releasably interconnected to said tab member and being normally located in exposed relation exteriorly of said body portion for ready access thereto, said key carrier assembly including a base plate to which said bracket is joined, said tab member including an exterior portion that projects outwardly of said central portion and an interior portion joined to said exterior portion and that underlies the base place of said key carrier assembly and is intimately joined thereto.

4. A key case as claimed in claim 3, a pocket formed on the exterior face of said central portion and having the mouth thereof located adjacent to said tab member wherein said key as secured to said tab member is receivable in said pocket when not in use.

5. A key case as claimed in claim 4, a chain having one end releasably connected to said tab, said key being mounted on the other end of said chain for insertion in said pocket.

6. A key case as claimed in claim 5, said tab member having an apex portion extending outwardly of said central portion in which an opening is formed, said one end of said chain having a connector joined thereto that is releasably mounted in the opening in said tab member.

7. A key case as claimed in claim 2, an interior panel joined only to an edge of said central portion and extending substantially the length thereof so that it is normally located in parallel realation to said central portion, but is hingedly movable relative thereto.

8. A key case as claimed in claim 7, said tab member and key carrier assembly being connected to said interior panel and movable therewith when it is hinged relative to said central portion.

9. A key case as claimed in claim 2, an interior panel fixed at one end thereof to said central portion and normally overlying the interior surface of said central portion, said base plate and interior portion of said tab member being directly joined to said interior panel so as to be free to move therewith relative to the central portion.

* * * * *